US007187252B2

(12) United States Patent
Cantrell et al.

(10) Patent No.: US 7,187,252 B2
(45) Date of Patent: Mar. 6, 2007

(54) APPARATUS FOR DELAYING RADIO FREQUENCY SIGNALS

(75) Inventors: William H. Cantrell, Rhome, TX (US); Dale R. Anderson, Colleyville, TX (US); William R. Meszko, Fort Worth, TX (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 10/999,516

(22) Filed: Nov. 30, 2004

(65) Prior Publication Data

US 2006/0114079 A1 Jun. 1, 2006

(51) Int. Cl.
*H01P 1/18* (2006.01)

(52) U.S. Cl. ..... 333/156; 333/160; 333/161

(58) Field of Classification Search ..... 333/156, 333/160, 161

See application file for complete search history.

(56) References Cited

U.S. PATENT DOCUMENTS 5,382,932 A * 1/1995 Monti ..... 333/245
6,337,609 B1 * 1/2002 Endou et al. ..... 333/160
6,529,097 B2 * 3/2003 Nakaguchi et al. ..... 333/134
6,556,102 B1 * 4/2003 Sengupta et al. ..... 333/161
6,952,148 B2 * 10/2005 Snyder et al. ..... 333/156
2003/0052750 A1 3/2003 Shamsaifar et al.
2003/0090344 A1 5/2003 Wang et al.

* cited by examiner

*Primary Examiner*—Robert Pascal
*Assistant Examiner*—Kimberly E Glenn
(74) *Attorney, Agent, or Firm*—Lalita W. Pace

(57) ABSTRACT

In the present technique for transmitting and delaying radio frequency signal transmission, an RF delay filter (102) is provided with at least one high permittivity material coaxial delay element (104) with each having an input port (114) and an output port (116). Multiple coaxial delay elements are operably coupled by a quarter-wave microstrip transmission line (230) to offset any frequency mismatch at the band edges of the delay elements. A series of capacitors (126, 128) are also included at each port of the coaxial elements to compensate for any resultant parasitic inductance.

15 Claims, 3 Drawing Sheets

APPARATUS FOR DELAYING RADIO FREQUENCY SIGNALS

TECHNICAL FIELD

This invention relates generally to the transmission delay of radio frequency signals.

BACKGROUND

A time delay is commonly imposed during radio frequency ("RF") signal transmission to provide for proper matching to the control paths. For example, feedforward linear power amplifiers (LPAs) employing high-power low-loss time-delay elements are used to provide time delay matching between the main and error feedforward paths. As a result, the amount of error correction is maximized over the widest possible operating bandwidth. This type of delay function is typically provided by an aluminum-block comb-line bandpass filter or a low-loss coaxial cable. Both common solutions, however, contain various benefits and inherent problems.

Coaxial cables, sometimes referred to as delay lines, were first used in the industry to obtain such an RF delay. They are currently still in widespread use. The benefit of coaxial cables is that there is no special tuning required. Thus, they are simple to use. Unfortunately, they tend to be bulky and expensive. For example, a longer coaxial cable may have to be installed to ensure a longer RF delay even though such a long bulky cable is not otherwise needed for the connection. Moreover, depending upon the quality and length of the coaxial cable, it can cost more than $100 dollars per installation, which can be quite costly when multiplied by hundreds of installations. As a result, other solutions, such as the aluminum-block comb-line bandpass filter, are often used in place of coaxial cable.

A typical aluminum-block comb-line bandpass filter is shown in FIG. 1 and indicated generally at 10. As shown, an input port 12 and an output port 14 are placed on a bottom surface 16 of the filter 10. On a top surface 18 of the filter 10, two screw holes 20, 22 are provided for mounting of the filter 10. A tuner 24 is sandwiched between the top surface 18 and the bottom surface 16, which provides multiple tuning adjustments 26 for controlling the RF delay.

Although such an aluminum-block comb-line bandpass filter 10 is able to provide low-loss delay at high power levels without the size and cost requirement of the bulky coaxial cable, the filter must be individually tuned using the tuning adjustments 26 of the tuner 24 and manually assembled, which are typically done by the supplier. Custom tuning and assembly adds extra manual labor to the cost of the filter 10. Specially, each of the tuning adjustments 26 shown has to be individually tuned by the supplier. Although the aluminum-block comb-line bandpass filter is cheaper than the coaxial cable, it is still fairly expensive since the production cost for each filter 10 costs approximately $45. Thus, the filter may be better than the coaxial cable, but it certainly has its own set of shortcomings, such as cost and labor.

There are other filters, such as a triple-mode ceramic delay filter and a tunable filter that has variable bandwidth and variable delay. All these other filters are similarly expensive and require specific tuning and manual assembly.

BRIEF DESCRIPTION OF THE DRAWINGS

The above needs are at least partially met through provision of the RF transmission apparatus described in the following detailed description, particularly when studied in conjunction with the drawings, wherein.

Figure 1:
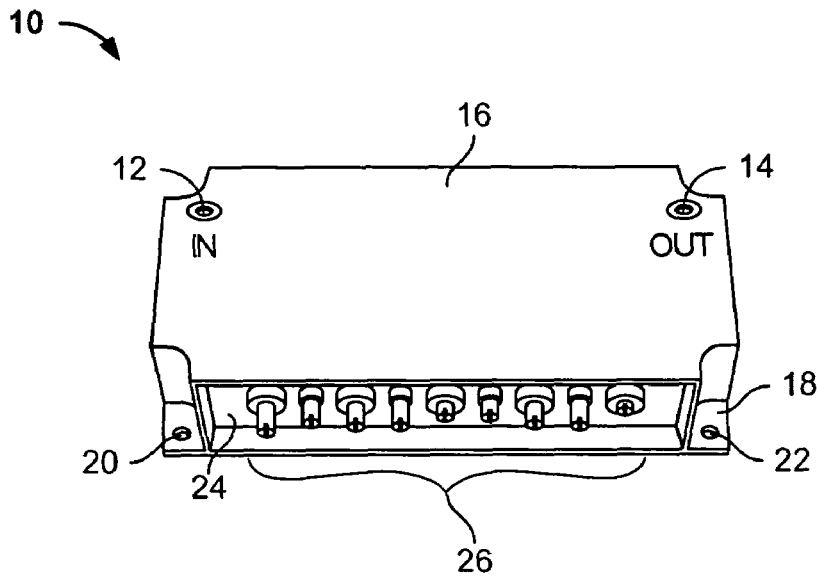
FIG. 1 (Prior Art)
FIG. 1 comprises an illustration of a typical aluminum-block comb-line bandpass filter.

Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present invention. Also, common and well-understood elements that are useful or necessary in a commercially feasible embodiment are often not depicted in order to facilitate a less obstructed view of these various embodiments of the present invention.

DETAILED DESCRIPTION

Generally speaking, pursuant to these various embodiments, an RF transmission apparatus has been provided with an RF delay filter that includes one or more high permittivity material coaxial delay elements having an input port and an output port. According to various embodiments, the coaxial delay element includes an inner conductor operably coupled between the input port and output port and an outer conductor that is divided from the inner conductor by the high permittivity material. In one specific embodiment, the high permittivity material is of a ceramic material. Moreover, with the various embodiments shown, the ports of the coaxial delay element are operably coupled with electrical connection tags. The ports of the coaxial delay element, in one embodiment, are each operably coupled to a capacitor to compensate for inductance.

In various embodiments shown, the coaxial delay element is preferably configured substantially according to an integer multiple of a half-wavelength with respect to a center frequency of the bandwidth. In one embodiment with an RF delay filter defined by two or more coaxial delay elements, a quarter wave microstrip transmission line is used to operably couple between at least two of the coaxial delay elements. In various embodiments, the RF delay filter is surface mounted onto a printed circuit board for feedforward linear power amplifier.

Through these various teachings, the RF signal transmission apparatus is provided with an RF delay filter that can operate at high power levels but with low loss. The apparatus provided has the benefits of being similar in size to a typical filter, but no tuning adjustment is required by the supplier because the present RF delay filter is substantially matched at multiples of a half-wavelength regardless of its characteristic impedance. The operating bandwidth of the overall resulting filter can be easily increased without having to reduce usable bandwidth. The production cost of the delay filter shown in various embodiments would cost less than $5 compared to other previous solutions, which range from $45 (e.g., other prior art filters) to over $100 (e.g., the coaxial cables). This translates to substantial saving in costs. The apparatus shown in the various teachings is also easy to manufacture since it can be auto-placed and/or surface mounted on the substrate or printed circuit board. All these exceptional benefits are achieved through the various teachings of the present RF signal transmission apparatus that imposes an RF delay while outputting at high power levels with minimum loss.

Figure 2:
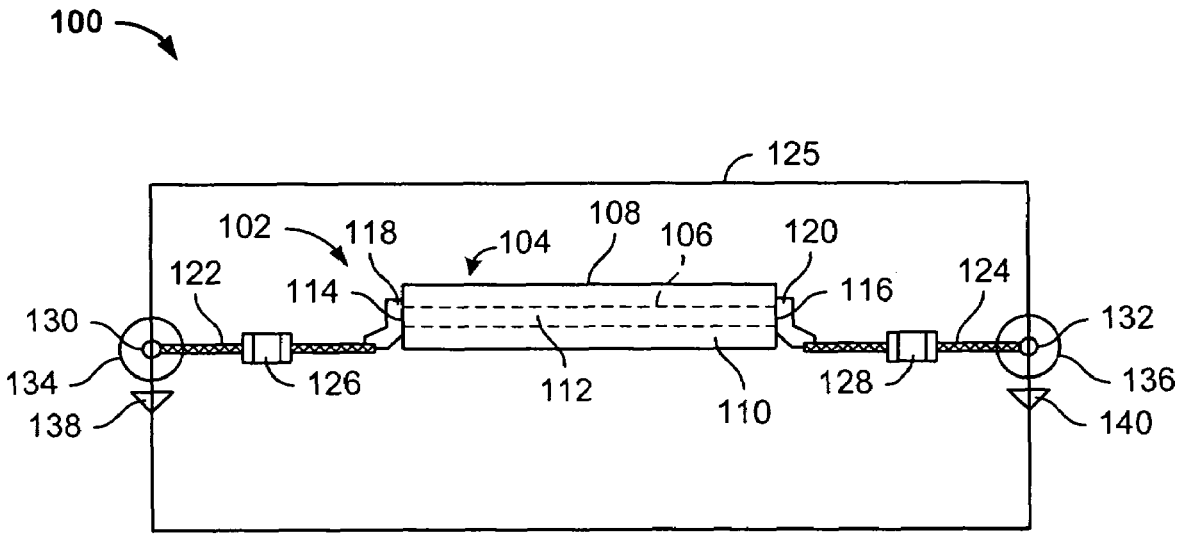
FIG. 2 comprises an illustration of an apparatus for transmitting RF signals having an RF delay filter with a single coaxial delay element according to one embodiment.

Referring now to the drawings, and in particular to FIG. 2, for purposes of providing an illustrative but nonexhaustive example to facilitate this description, an RF signal transmission apparatus with an RF delay filter having a single coaxial delay element is shown and indicated generally at 100. Those skilled in the art, however, will recognize and appreciate that the specifics of this illustrative example are not specifics of the invention itself and that the teachings set forth herein are applicable in a variety of alternative embodiments. For example, other coaxial delay elements can be used and multiple coaxial delay elements can also be included. As such, various alternative embodiments that will be readily appreciated by a skilled artisan and are within the scope of the invention.

In this embodiment, an RF delay filter 102 with a single coaxial delay element 104 is included with the apparatus 100. As shown, the coaxial delay element 104 includes an inner conductor 106, an outer conductor 108, and a high permittivity material 110 separating the inner conductor and the outer conductor from one another. The coaxial delay element 104 has an elongated shape, although other shapes are contemplated. The inner conductor 106 is configured with a rounded opening 112 internally coated with an electrically conductive material. An input port 114 and an output port 116 are provided at each end of the rounded opening 112 of the inner conductor 106 for propagating the RF signals. Specifically, two electrical connection tags 118, 120 are respectively coupled to the input port 114 and the output port 116 of the inner conductor 106. The electrical connection tags 118, 120 are then each coupled to an electrical path 122, 124 of a printed circuit board 125 of the apparatus 100. As a result, the coaxial delay element 104 makes an electrical connection to the printed circuit board 125, and accordingly provides for time delay of the RF signal transmission for the structure.

The outer conductor 108 with square cross sections is similarly defined by the elongated shape of the coaxial delay element 104, and preferably all the surfaces of the outer conductor 108 are coated with an electrically conductive material, such as aluminum, for grounding the RF delay filter 102. The high permittivity material 110, in one embodiment, is substantially made out of a ceramic material, which effectively separates the inner conductor 106 from the outer conductor 108. From this configuration of the RF delay filter 102 shown, a coaxial transmission line has been created, which is used to cause a delay in the RF signal launched through the apparatus 100. In fact, the construction of the RF delay filter 102 is similar to an ordinary quarter-wave ceramic resonator used in voltage-controlled oscillators ("VCOs"), but with the shorted-end replaced by one of the electrical connection tags 118, 120. Moreover, since the RF delay filter 102 is matched at multiples of a half-wavelength with respect to the center frequency regardless of its characteristic impedance, no individual tuning is required of the RF delay filter. It has also been mathematically shown, using ABCD-parameter analysis, that the characteristic impedance (with mismatch normalized to 50 ohms) causes multiple reflections, and hence, imparts a multiplicative effect to the amount of time-delay encountered by the RF signal. The delay is far in excess of what would normally be encountered by a non-reflective (matched) propagation of the RF signal through the same ceramic structure. Effectively, the RF delay filter 102 can be thought of as a coaxial cable that is capable of transmitting RF signals from one end to the other.

In particular, the RF delay filter (e.g., the coaxial transmission line) 102 exhibits characteristic impedance Zc terminated at each end with system impedance Zo, and both the characteristic impedance Zc and system impedance Zo are commonly known in the art. The electrical length of the coaxial delay element 102, in one embodiment, is chosen to be either 0.5λ or 1.0λ at the center frequency $\omega_0$, where $\omega_0=2\pi f_0$ such that $f_0$ is the center frequency in Hertz, which is also commonly known in the art. As a result, impedance matching is not required because the apparatus 100 is mostly matched at multiples of a half wavelength. This is true regardless of the characteristic impedance of the coaxial delay element 104. In other words, given the integer multiple of a half-wavelength at the center frequency, the apparatus 100, as a result, is substantially matched regardless of the values chosen for Zc and Zo (ignoring parasitics from the electrical connection tags 118, 120). Impedance matching of the two ports is neither required nor desired since the greater the mismatch, the greater the delay.

This characteristic impedance of the coaxial delay element 104 can be estimated from the formula $$Zc = \frac{1}{2\pi}\sqrt{\frac{\mu}{\varepsilon}}\ln\left(1.079\frac{b}{a}\right) \cong \frac{60}{\sqrt{\varepsilon_r}}\ln\left(1.079\frac{b}{a}\right), \tag{1}$$

where $\epsilon$ is the permittivity of the ceramic material, $\epsilon_r$ is the relative permittivity, 'b' is the outer diameter (flat-to-flat), μ is the permeability of the ceramic material, 'a' is the inner diameter, and the approximation factor 1.079 has been included to account for the square cross section of the material. All these mathematical variables are commonly known in the art. Depending on the 'b/a' ratio, the characteristic impedance Zc is usually in the 8 to 14Ω range for low-loss ceramic material with $\epsilon_r \approx 38$. The velocity of propagation is inversely proportional to $\sqrt{\epsilon_r}$ and slows in a material with high permittivity. This provides a method to shrink the size of the RF delay filter 102 for a given amount of delay.

There is a limit, though, to how high the permittivity can be chosen. In order to suppress higher order (non-TEM) modes, the delay element should not be operated at frequencies where the $TE_{11}$ mode is supported. ($TE_{11}$ being the lowest evanescent mode.) A simple empirical formula can be used to determine the upper frequency limit, $$f_{\max} = 0.95\frac{190.8522}{(a+b)\sqrt{\varepsilon_r}}, \tag{2}$$

where the maximum usable frequency is in GHz and 'a' and 'b' are in millimeters. The frequency limit also includes a 5% margin of safety. Using standard resonator cross-sectional dimensions with $\epsilon_r \approx 38$, the upper frequency limit is typically above 1.4 GHz. Note, however, that $f_{max}$ is higher than 2.7 GHz using the D36 ceramic material and common resonator dimensions.

Although, as mentioned, the apparatus 100 is a substantially matched structure with the configuration of the RF delay filter 102. Because of the connection points, specifically the electrical connection tags 118, 120, at each end of the RF delay element 104, there are inevitably some resultant tag parasitics that must be compensated. To account for the parasitics of these electrical connection tags 118, 120, a series chip capacitor is added onto the printed circuit board 125. Specifically, in this embodiment shown, a capacitor 126, 128 is respectively connected to the transmission paths 122, 124 of the printed circuit board 125 to cancel out the parasitic inductance caused by the electrical connection tags 118, 120. Each compensation capacitor 126, 128 is preferably chosen to cancel out the reactance of the parasitic inductance at the center frequency.

It should be noted, however, that because of the limitation of the capacitors available today, the various teachings have a frequency limitation due to the parasitics associated with the electrical connection tags 118, 120. With proper compensation, the apparatus 100 works up to about 1 GHz in practice, but not higher. This is due to the series inductance of the electrical connection tags 118, 120. This limitation, however, may be resolved if the parasitic inductance can somehow be compensated. Thus, other alternative embodiments are contemplated, and they are within the present scope of the various teachings.

For the remaining portions of the apparatus 100, the transmission paths 122, 124 continue respectively to an input connector 130 and an output connector 132 on the printed circuit board 125, which also respectively includes an outer shield 134, 136 with a ground 138, 140 at each connector. As shown, the apparatus 100 shown can be easily manufactured and is surface mountable on the printed circuit board 125. The RF delay filter 102 provides for low-loss delay at high-power levels of the RF signal transmission, which does not require hand tuning while being small in size compared to bulky coaxial cables. With all these benefits and more, the present apparatus 100 shown is still drastically less expensive than the prior solutions.

Figure 3:
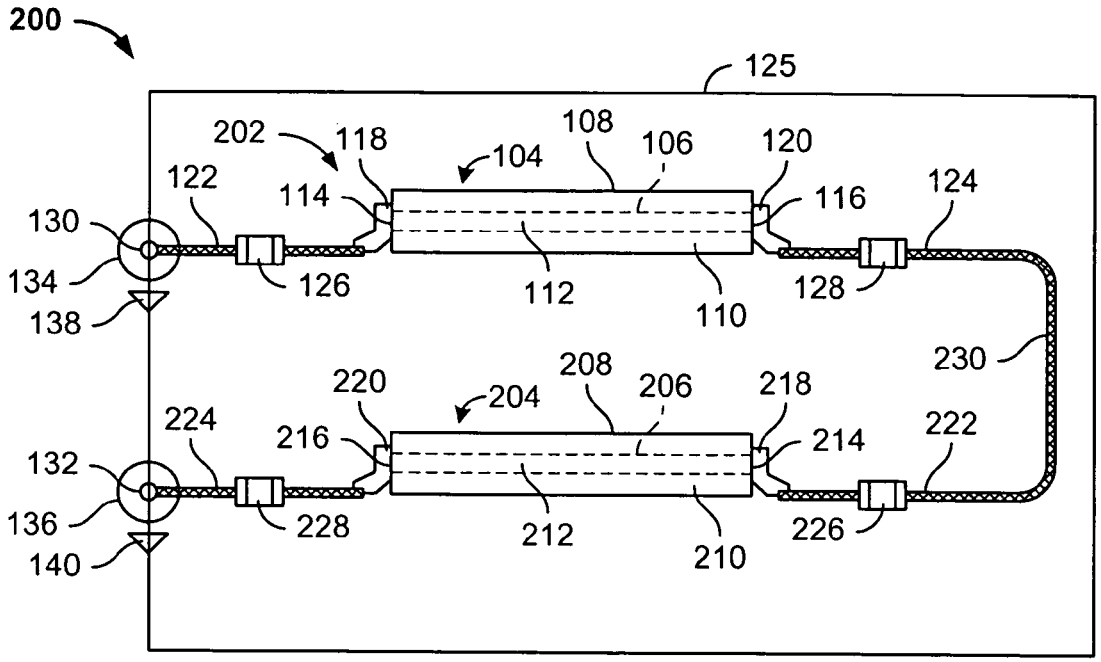
FIG. 3 comprises an illustration of an apparatus for transmitting RF signals having an RF delay filter with two coaxial delay elements according to one embodiment.

Turning now to FIG. 3, an apparatus for transmitting RF signals having an RF delay filter with two coaxial delay elements according to one embodiment is shown and indicated generally at 200. For simplicity and clarity of the description of various teachings, the same elements that are referred to in FIG. 2 will use the same numerical reference number here. For other newly added elements that are similar to the elements previously shown in FIG. 2, they will be referenced with a "2" that will replace the "1" at the first number of the previous numerical references of similar elements.

Considering the bandwidth and ripple requirements of the current system, a single RF delay filter may not adequately provide enough delay without causing excessive narrowing of the bandwidth due to mismatched attenuation at the band edges. To solve this, additional elements can be added to an RF delay filter 202, which can be cascaded onto the printed circuit board 125. Thus, shown as an example in FIG. 3, two coaxial delay elements have been included in this embodiment of the RF delay filter 202. Starting from the top of the printed circuit board 125, a similar first coaxial delay element 104 is included, which includes all the same elements shown in FIG. 2. One of the differences in this embodiment is that the transmission path 124 is not connected to the output connector 132 as previously shown in FIG. 2. Rather, the transmission path 124 shown in this embodiment is operably coupled (e.g., specifically connected) to a quarter-wave microstrip transmission line 230 that acts as an impedance inverter with a characteristic impedance of Zo.

The quarter-wave microstrip transmission line 230 is next coupled to a second coaxial delay element 204 via another transmission path 222. The quarter-wave microstrip transmission line 230 has the effect of reversing the frequency mismatch at the band edges as the RF signal propagates from one RF delay element 104 to the next RF delay element 204. This increases the delay for a given bandwidth. Although the first and the second RF delay elements 104, 204 have the same wavelength in this embodiment shown, other combinations of wavelength elements can also be implemented. Combinations of half- and/or full-wavelength elements, however, yield an attractive filter response. Since the optimal combination of the wavelength elements depends upon the tradeoff between amplitude ripple and time-delay flatness (deviation from linear phase), other alternative embodiments are contemplated and are within the scope of these various teachings even if not shown.

Along the transmission path 222, another capacitor 226 is operably connected to the second coaxial delay element 204 and the quarter-wave microstrip transmission line 230. Similar to the first coaxial delay element 104, the second coaxial delay element 204 is operably coupled to the transmission path 222 via an electrical connection tag 218 on an input port 214 of an inner conductor 206 of the second coaxial delay element. The inner conductor 206, in this embodiment, is similarly configured with a rounded opening 212 internally coated with an electrically conductive material, and a high permittivity material 210 is used to divide the inner conductor and an outer conductor 208. On an output port 216 of the inner conductor 206, another electrical connection tag 220 is similarly connected to another transmission path 224, which is in turn connected to the output connector 132 of the printed circuit board 125. Along the transmission path 224, another capacitor 228 is similarly placed to compensate the parasitic inductance of the electrical connection tag 220 of the second coaxial delay element 204.

As shown, one of the differences between the embodiment with a single coaxial delay element shown in FIG. 2 and the embodiment with two coaxial delay elements shown in FIG. 3 is the use of the quarter-wave microstrip transmission line 230, which effectively functions as an impedance inverter with characteristic impedance of Zo. As a result, the frequency mismatch at the band edges as the RF signal propagates from one coaxial delay element to another has been reversed using the quarter-wave microstrip transmission line 230. If desired, more RF delay can be added with each additional coaxial delay element while minimizing the effect of narrowing the bandwidth due to mismatched attenuation at the band edges. As a result, this extends the operating bandwidth of the overall resulting apparatus 200. Moreover, in this embodiment shown, there is no special hand tuning or manual assembly of the apparatus 200. Of course, depending upon the needs of the implementation, the number of coaxial delay elements that can be added is limited only by hardware considerations. Other exemplary embodiments with multiple coaxial delay elements are shown in FIGS. 4 and 5, but a skilled artisan can readily appreciate that other embodiments with one or multiple different wavelength coaxial delay elements are within the scope of these various teachings.

Figure 4:
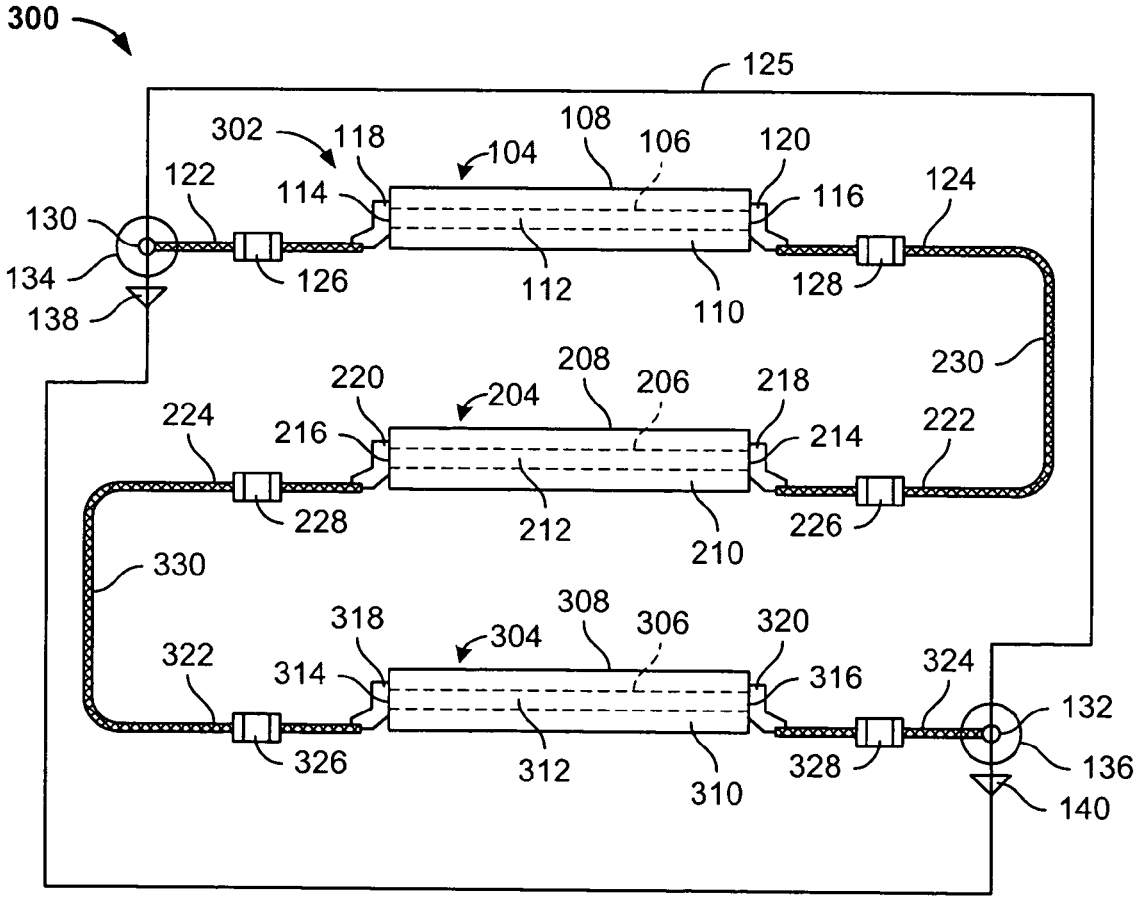
FIG. 4 comprises an illustration of an apparatus for transmitting RF signals having an RF delay filter with three coaxial delay elements according to one embodiment.
Figure 5:
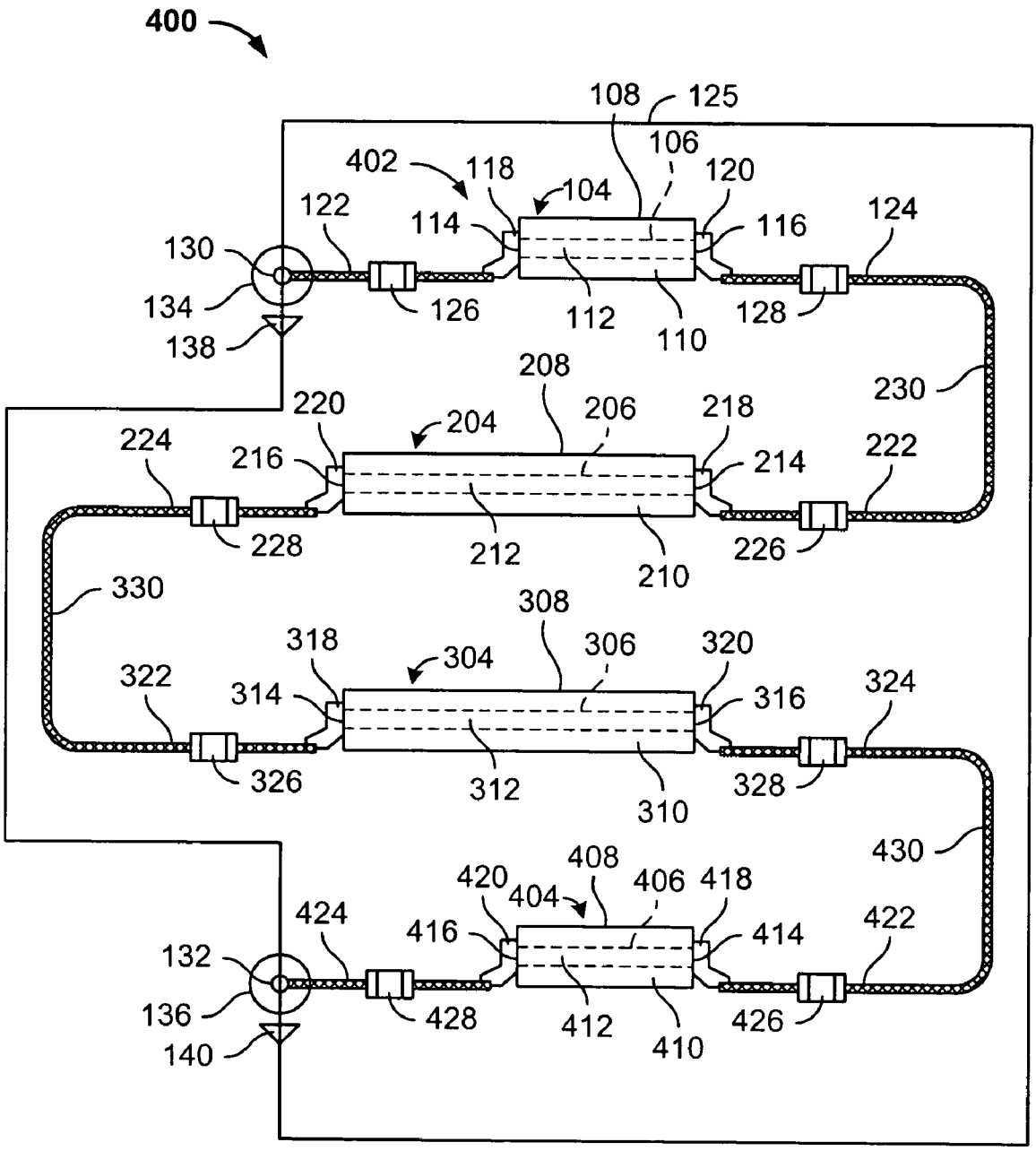
FIG. 5 comprises an illustration of an apparatus for transmitting RF signals having an RF delay filter with four coaxial delay elements according to one embodiment.

Turning now to FIG. 4, an apparatus for transmitting RF signals having an RF delay filter with three coaxial delay elements is shown as an exemplary embodiment, which would be indicated generally at 300. Again, for simplicity and clarity of the description of various teachings, the same elements that are referred to in FIGS. 2 and 3 will use the same numerical reference number. For other newly added elements that are similar to the elements previously shown in FIGS. 2 and 3, they will be referenced with a "3" that will replace the "1" and "2" at the first number of the previous numerical references of similar elements.

In this embodiment, between the input connector 130 and the output connector 132 of the printed circuit board 125, three RF delay elements 104, 204, 304 of an RF delay filter 302 are operably coupled with each other through the multiple transmission paths 122, 124, 222, 224, 322, 324. In this embodiment, another quarter-wave microstrip transmission line 330 is used to connect the second coaxial delay element 204 and the third coaxial delay element 304, which similarly includes a high permittivity material 310 dividing an outer conductor 308 and an inner conductor 306. The inner conductor 306 of the third coaxial delay element 304 is similarly configured with a rounded opening 312 internally coated with an electrically conductive material. As shown, the coaxial delay elements 104, 204, 304 are cascaded onto the printed circuit board 125. Specifically, the electrical connection tag 120 connected to the output port 116 of the first coaxial delay element 104 is operably coupled to the electrical connection tag 218 connected to the input port 214 of the second coaxial delay element 204 via the first quarter-wave microstrip transmission line 230. Likewise, the path is continued with the electrical connection tag 220 connected to the output port 216 of the second coaxial delay element 204 being operably coupled to an electrical connection tag 318 connected to an input port 314 of the third coaxial delay element 304. On the other end of the third coaxial delay element 304, an electrical connection tag 320 connected to an output port 316 of the third coaxial delay element is operably coupled to the output connector 132 on the printed circuit board 125. The third coaxial delay element 304 similarly Turning now to the last exemplary embodiment shown in FIG. 5, an apparatus for transmitting RF signals having an RF delay filter with four coaxial delay elements is shown and indicated generally at 400. Again, for simplicity and clarity of the description of various teachings, the same elements that are referred to in FIGS. 2–4 will use the same numerical reference number. For other newly added elements that are similar to the elements previously shown in FIGS. 2–4, they will be referenced with a "4" that will replace the "1," "2," and "3" at the first number of the previous numerical references of similar elements.

This embodiment is very similar to the embodiment shown in FIG. 3 except that a fourth coaxial delay element 404 is added to the RF delay filter 402, which results in an additional third quarter wave microstrip transmission line 430 being added between the third coaxial delay element 304 and the fourth coaxial delay element 404. There is another difference in that the first and fourth coaxial delay element 104, 404 are of a different wavelength from that of the second and third coaxial delay element 204, 304. Specifically, the first and fourth coaxial delay elements 104, 404 are each defined by a half-wavelength, whereas the second and the third coaxial delay elements are defined by a full-wavelength. The fourth coaxial delay element 404 includes similar functioning elements of an inner conductor 406 and an outer conductor 408 divided by a high permittivity material 410. The inner conductor 406 is configured with a similar rounded opening 412 internally coated with an electrically conductive material. On each end of the inner conductor, an input port 414 and an output port 416 respectively connected to two electrical connection tags 418, 420. As a result, a connection is made with two transmission path 422, 424 on the printed circuit board 125. Similarly, two capacitors 426, 428 are respectively placed along the two transmission path 422, 424. As described in this embodiment, the first and fourth coaxial delay elements 104, 404 have similar components and same wavelengths, which are different from that of the second and third coaxial delay elements 204, 304.

This embodiment emphasizes that the wavelengths of the coaxial delay elements do not have to be of the same wavelengths as shown in the previous embodiments. Nevertheless, the combinations of half- and/or full-wavelength elements are preferred since they tend to yield a more attractive filter response. The tradeoff is between amplitude ripple and time-delay flatness (deviation from linear phase) of these coaxial delay elements. As readily appreciated by a skilled artisan, there may be other alternative embodiments that may include all different wavelength coaxial delay elements as long as they are suited for the specific result and implementation desired. Thus, as mentioned previously, variations to the embodiments shown in the various teachings are practically limitless. In light of this, other alternative embodiments are within the scope of these various teachings.

With these various teachings shown, a novel RF delay technique has been provided. As a result of the various teachings shown, an RF delay filter at high power levels with low loss has been provided, which proves to be more efficient and cost effective than prior solutions. The present RF delay filter is able to combine both benefits of the coaxial cable requiring no tuning adjustment or manual assembly and the aluminum block comb-line filter being less bulky. Since the coaxial delay elements can easily be added to increase the RF delay without narrowing the usable bandwidth, the various teachings show an RF delay filter that is also more flexible than other prior solutions. Best of all, even with all these numerous benefits offered by the various teachings of the embodiments shown, the present RF delay filter still costs substantially less than the other prior solutions. Moreover, the apparatus shown in the various teachings is also easy to manufacture since it can be auto-placed and/or surface mounted on the substrate or printed circuit board. As a result, no special technique is required to manufacture the various embodiments shown.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. An apparatus for delaying radio frequency signals comprising:

a plurality of coaxial delay elements comprised of a high permittivity material;

an input port operably coupled to one end of at least one coaxial delay element of the plurality of coaxial delay elements;

an output port operably coupled to another end of the at least one coaxial delay element of the plurality of coaxial delay elements; and at least one quarter wave microstrip transmission line operably coupled between at least two of the plurality of the coaxial delay elements.

2. The apparatus according to claim 1 further comprising:

a first capacitor operably coupled to the input port;

a second capacitor operably coupled to the output port.

3. The apparatus according to claim 1 further comprising:

a first electrical connection tag operably coupled to the input port;

a second electrical connection tag operably coupled to the output port.

4. The apparatus according to claim 1, wherein the at least one coaxial delay element comprises:

an inner conductor operably coupled between the input port and the output port;

an outer conductor, wherein the high permittivity material divides the inner conductor and the outer conductor.

5. The apparatus according to claim 4, wherein the high permittivity material is comprised of a ceramic material.

6. The apparatus according to claim 1, wherein the at least one coaxial delay element is configured substantially according to an integer multiple of a half-wavelength with respect to a center frequency.

7. An apparatus for delaying radio frequency signals comprising:

a plurality of coaxial delay elements comprised of a high permittivity material, wherein at least one of the plurality of coaxial delay elements comprises an input port and an output port;

an electrical connection tag operably coupled to the input port and an output port;

a capacitor operably coupled to the electrical connection tag;

a quarter-wave microstrip transmission line operably coupled between at least two of the plurality of coaxial delay elements.

8. The apparatus according to claim 7, wherein the plurality of coaxial delay elements are configured substantially according to an integer multiple of a half-wavelength with respect to a center frequency.

9. The apparatus according to claim 7, wherein each of the plurality of coaxial delay elements comprises:

an inner conductor operably coupled between the input port and the output port;

an outer conductor, wherein the high permittivity material divides the inner conductor and the outer conductor.

10. An apparatus for transmitting radio frequency signals comprising:

a printed circuit board comprised of a first input port and a first output port;

a radio frequency delay filter operably coupled on a surface of the printed circuit board between the first input port and the first output port, wherein the radio frequency delay filter comprises at least one coaxial delay element comprised of a high permittivity material connected between a second input port and a second output port; and wherein the at least one coaxial delay element is configured substantially according to an integer multiple of a half-wavelength with respect to a center frequency.

11. The apparatus according to claim 10, wherein the at least one coaxial delay element comprises:

a first electrical connection tag operably coupled to the second input port;

a second electrical connection tag operably coupled to the second output port.

12. The apparatus according to claim 11, wherein the at least one coaxial delay element comprises:

a first capacitor operably coupled to the first electrical connection tag;

a second capacitor operably coupled to the second electrical connection tag.

13. The apparatus according to claim 10, wherein the at least one coaxial delay element comprises:

an inner conductor operably coupled between the second input port and the second output port;

an outer conductor, wherein the high permittivity material divides the inner conductor and the outer conductor.

14. The apparatus according to claim 10, wherein the at least one coaxial delay element comprises a plurality of coaxial delay elements, and further comprising:

at least one quarter wave microstrip transmission line operably coupled between at least two of the plurality of the coaxial delay elements.

15. The apparatus according to claim 10, wherein the apparatus is a surface-mountable circuit for feedforward linear power amplifier.

* * * * *